US005813847A

United States Patent [19]

Eroglu et al.

[11] Patent Number: 5,813,847

[45] Date of Patent: Sep. 29, 1998

[54] DEVICE AND METHOD FOR INJECTING FUELS INTO COMPRESSED GASEOUS MEDIA

[75] Inventors: Adnan Eroglu, Untersiggenthal; Hans Peter Knöpfel, Besenbüren, both of Switzerland; Peter Senior, Leicester, Great Britain

[73] Assignee: ABB Research Ltd., Zurich, Switzerland

[21] Appl. No.: 691,674

[22] Filed: Aug. 2, 1996

[30] Foreign Application Priority Data

Oct. 2, 1995 [DE] Germany ..... 195 36 837.1

[51] Int. Cl.[6] ..... F23C 5/00

[52] U.S. Cl. ..... 431/8; 431/285; 431/354; 431/103; 431/174; 431/284

[58] Field of Search ..... 431/8, 285, 354, 431/173, 174, 284

[56] References Cited

U.S. PATENT DOCUMENTS 5,375,995 12/1994 Dobbeling et al. ..... 431/8

FOREIGN PATENT DOCUMENTS

| | | |
|---|---|---|
| 2356427 | 5/1974 | Germany . |
| 3724234A1 | 2/1989 | Germany . |
| 4310185C1 | 6/1994 | Germany . |
| 1350115 | 4/1974 | United Kingdom . |

*Primary Examiner*—Larry Jones
*Attorney, Agent, or Firm*—Burns, Doane, Swecker & Mathis, L.L.P.

[57] ABSTRACT

A device for injecting fuels (4) into compressed gaseous media essentially comprises a cylindrical hollow body (24) with at least one fuel feed passage (2) and means for the introduction of compressed atomization air (5). A swirl chamber (1) is arranged in the interior of the hollow body (24), this swirl chamber being connected via at least one inlet opening (6) to the fuel feed passage (2). The cross-section of the swirl chamber (1) narrows in the direction of flow of the atomization air passed through the interior of the hollow body (24), thereby forming a cone (8). A dividing wall (20), which extends downstream at least as far as the center of the inlet openings (6), is arranged upstream of the swirl chamber (1), between the fuel in the swirl chamber (1) and the atomization air (5). A method for operating the device is furthermore described.

8 Claims, 3 Drawing Sheets

Fig. 1
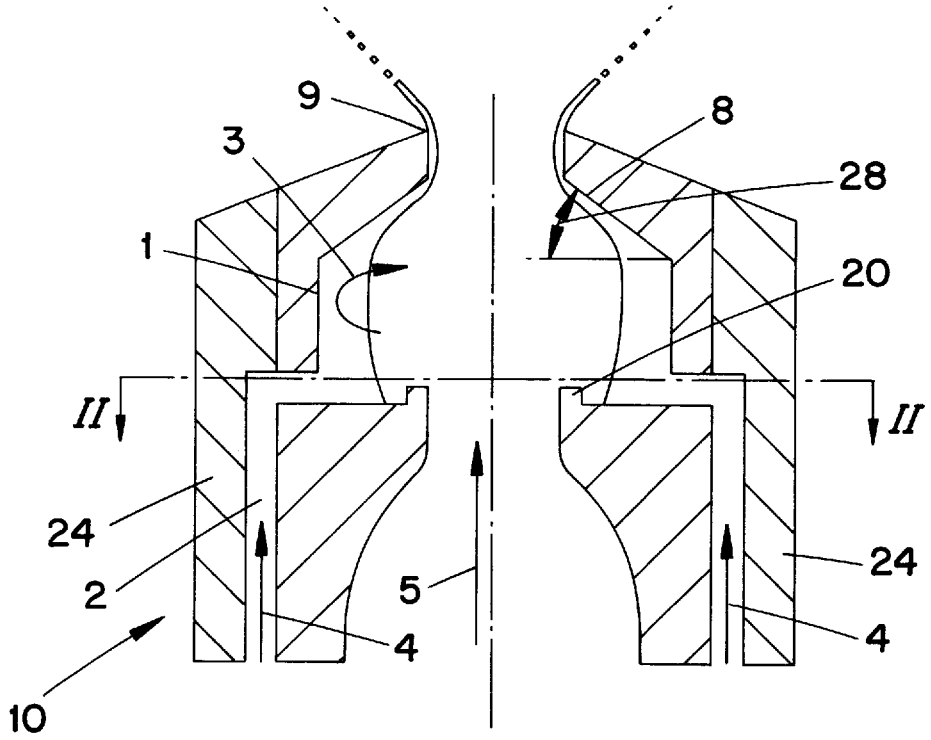
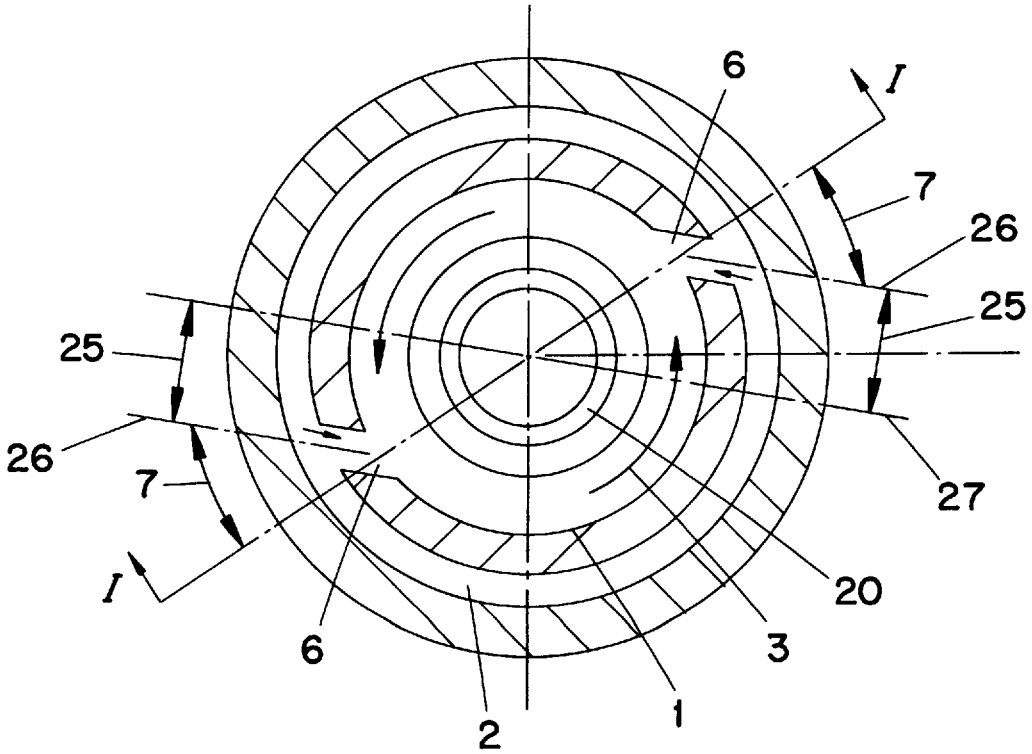
Fig. 2

Fig. 3
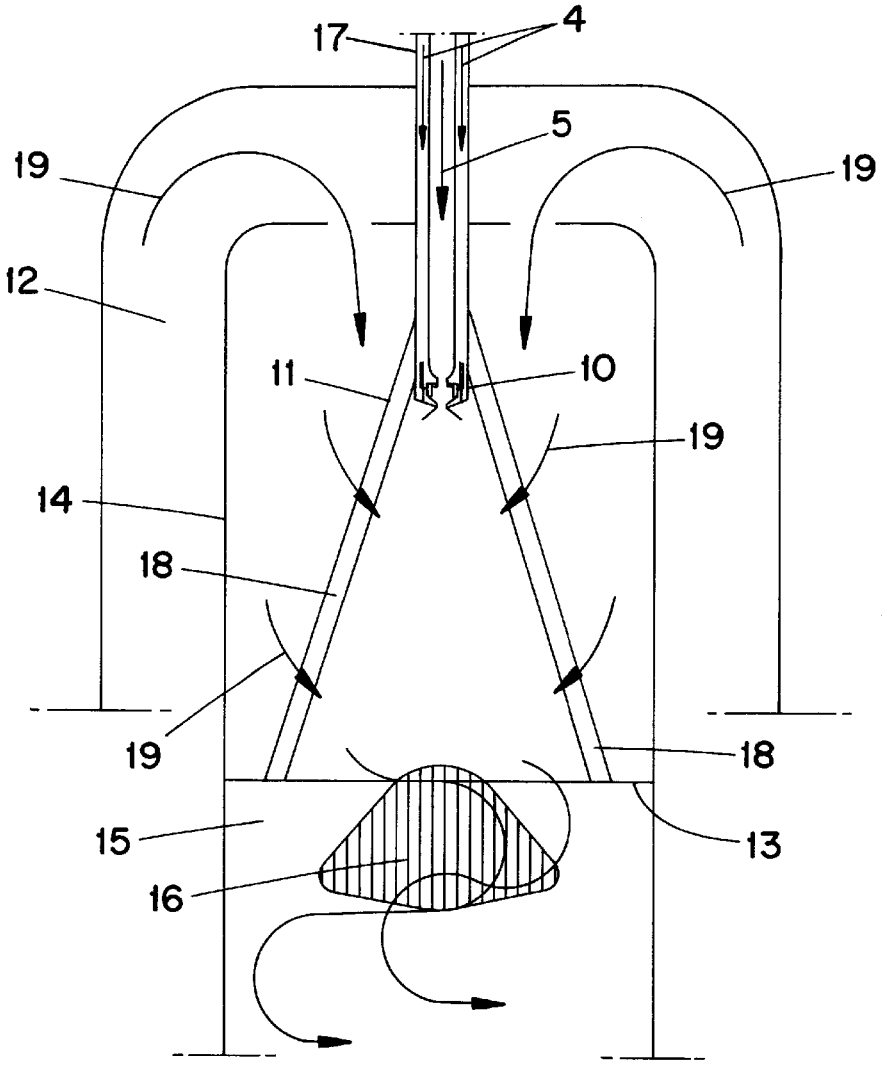
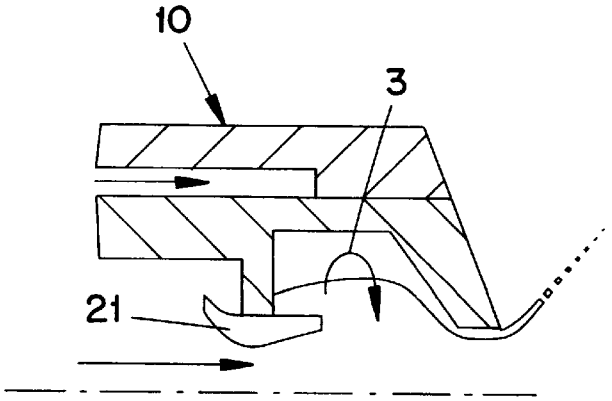
Fig. 7

DEVICE AND METHOD FOR INJECTING FUELS INTO COMPRESSED GASEOUS MEDIA

BACKGROUND OF THE INVENTION

1. Field of the Invention

The invention relates to a device for injecting fuels into compressed gaseous media, essentially comprising a cylindrical hollow body with at least one fuel feed passage and means for the introduction of compressed atomization air. The invention likewise relates to a method for operating the device.

2. Discussion of Background

Devices and methods of this kind for injecting fuels into compressed gaseous media are known. The momentum of the compressed atomization air is used to atomize liquid fuels into the compressed gaseous media. One problem of such injection devices is the relatively high consumption of atomization air used for atomization. Very fine droplets must furthermore be produced since pollutant emissions increase with droplet size.

SUMMARY OF THE INVENTION

Accordingly, one object of the invention is to provide a novel device and a novel method for injecting fuels into compressed gaseous media of the type stated at the outset in which the fuel is finely atomized and the pollutant emissions lowered.

According to the invention, this is achieved by virtue of the fact that a swirl chamber is arranged in the interior of the hollow body, this swirl chamber being connected via at least one inlet opening to the fuel feed passage, that the cross-section of the swirl chamber narrows in the direction of flow of the atomization air passed through the interior of the hollow body, thereby forming a cone, and that a dividing wall, which extends downstream at least as far as the center of the inlet openings, is arranged upstream of the swirl chamber, between the fuel in the swirl chamber and the atomization air.

A method for operating the device is distinguished by the fact that fuel is fed to a swirl chamber from inlet openings and, as a result, as the fuel is introduced into the swirl chamber, a swirling fuel flow arises, that the atomization air is delivered through the center of the swirl chamber, which narrows in the direction of flow of the atomization air to form a cone, that the fuel reaches an atomization edge which breaks up the fuel film into droplets, and that the atomization air applies additional shear forces to the fuel film and assists the break-up of the fuel into droplets.

Among the advantages of the invention is the fact that the injection nozzle is of simple and robust construction.

Moreover, an injection device of this kind has a very low consumption of atomization air. The atomization air in the interior of the hollow body reduces the dwell time and the recirculation of the fuel in the swirl chamber considerably. This is particularly advantageous for the avoidance of spontaneous ignition at high fuel pressures.

It is particularly expedient if turbulence chambers are machined into the cone of the swirl chamber. The swirling flow in the swirl chamber gives rise in these turbulence chambers to longitudinal vortices which increase the turbulence of the fuel film at the atomization edge. It is thereby possible to achieve very fine atomization.

It is furthermore expedient to pass the atomization air through the interior of the swirl chamber at supersonic speed since the shock waves of the supersonic flow and the shocks thereby produced assist the atomization of the fuel. If the dividing wall in the interior of the hollow body is designed as a Laval nozzle, additional high-frequency oscillations of the shock waves are produced and atomization is further improved.

Radial arrangement of the injection devices in a nozzle head is particularly advantageous. As a result, the injection of the fuel is perpendicular to the combustion air, thereby increasing the depth, of penetration of the fuel.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 shows a partial longitudinal section through a nozzle along the line I—I in FIG. 2;

FIG. 2 shows a partial- cross-section through the nozzle along the line II—II in FIG. 1;

FIG. 3 shows a partial longitudinal section through a combustion chamber;

FIG. 7 shows a partial longitudinal section through a nozzle for supersonic flow.

DESCRIPTION OF THE PREFERRED EMBODIMENT

Figure 4:
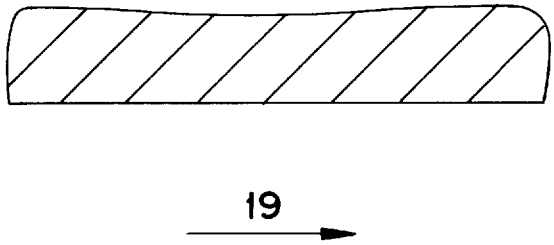
FIG. 4 shows a partial longitudinal section through a nozzle head with radially arranged nozzles.

Referring now to the drawings, wherein like reference numerals designate identical or corresponding parts throughout the several views, in which only those elements which are essential for an understanding of the invention are shown, FIGS. 1 and 2 show a fuel injection device 10, referred to below as a nozzle, which is designed essentially as a cylindrical hollow body 24 and has an internal swirl chamber 1. The inside diameter of the swirl chamber 1 is in each case chosen as a function of the power.

Liquid fuel 4 is introduced into the swirl chamber 1 via an annular fuel feed passage 2 and a plurality of inlet openings 6.

The inlet openings 6 are set at an angle 7 to the line joining the inlet opening 6 and the center of the hollow body 24. The angle 7 can be between zero and approaching ninety degrees but an acute angle is preferably chosen. The inlet openings 6 are furthermore offset relative to the center of the swirl chamber 1 by an offset 25 between a center line 26 through the inlet opening 6 and a center line 27, parallel thereto, through the center of the swirl chamber 1. The angle 7 and the offset 25 are each chosen in such a way that a swirling fuel flow 3 arises as the fuel 4 is introduced into the swirl chamber 1. Atomization air 5, referred to below merely as air, is delivered at high pressure in the direction of the arrow through the center of the hollow body 24. The swirl chamber 1 is designed in such a way that its cross-section narrows in the direction of flow of the air 5, thereby forming a cone 8. The angle of inclination 28 of the cone 8 is between fifteen and seventy-five degrees ($15° \leqq$ angle of incidence $28 \leqq 75°$).

In the cone 8, the fuel flows flowing in through the inlet openings 6 are combined and accelerated. In the swirl chamber 1, the swirling fuel flow 3 begins to flow in the direction of flow of the air 5. The fuel then reaches an atomization edge 9, which breaks the fuel film up into droplets. The air 5 flowing through the center of the hollow body 24 applies additional shear forces to the fuel film and assists the break-up of the fuel into droplets. The air furthermore fills the central zone of the nozzle 10, thereby drastically reducing recirculation and the long dwell time of the fuel in the swirl chamber 1 and, especially, in the cone 8. A dividing wall 20 between the fuel and the air 5 is arranged upstream of the swirl chamber 1. In the downstream direction, the dividing wall 20 reaches at least as far as the center of the inlet openings 6 and at most as far as three times the diameter of the inlet openings beyond the inlet openings 6. By virtue of the dividing wall 20, the fuel film can develop in the swirl chamber 1 without being influenced by the air flow 5.

The air 5 can be passed through the center of the swirl chamber 1 at subsonic or supersonic speed. However, the employment of supersonic flow requires an additional compressor for the air 5. The shocks of the shock waves of the supersonic flow assist the atomization of the fuel film at the atomization edge.

FIG. 3 shows the use of the nozzle 10 in a burner 11 of a gas turbine. A jacketed plenum 12, which generally receives the combustion air 19 delivered by a compressor (not shown), guides the combustion air to a combustion chamber 15. This can be an individual combustion chamber or an annular combustion chamber.

An annular dome 14 is placed on the top end of the combustion chamber, which is bounded by a front plate 13. The burner 11 is arranged in such a way in this dome that the burner outlet is at least approximately flush with the front plate 13. Via the dome wall, which is perforated at its outer end, the combustion air 19 flows out of the plenum 12 into the interior of the dome and impinges upon the burner. The fuel is fed to the burner via a fuel lance 17 which passes through the dome and plenum wall. The nozzle 10 is arranged at the end of the fuel lance, in the interior of the burner 11. Fuel 4 and air 5 are fed to the nozzle 10 via the fuel lance 17, which is of double-walled design. The air 5 is generally branched off from the combustion air at the outlet of the compressor or, other than as shown in FIG. 3, can be taken directly from the plenum 12.

The premix burner 11 illustrated schematically is a so-called double-cone burner, as known, for example, from U.S. Pat. No. 4,932,861. It essentially comprises two hollow conical parts, which are nested in the direction of flow. The respective center lines of the two parts are offset relative to one another. Along their length, the adjacent walls of the two parts form tangential slots 18 for the combustion air 19, which in this way reaches the interior of the burner.

The burner can, of course, also be operated with gaseous fuel. For this purpose, longitudinally distributed gas inflow openings in the form of nozzles are provided in the walls of the two parts in the region of the tangential slots 18. These nozzles can be fed by means of special conduits or by means of the fuel lance 17. In gas operation, mixture formation with the combustion air 19 begins right in the zone of the slots 18.

An as far as possible homogeneous fuel concentration is established at the outlet of the burner 11 over the annular cross-section supplied. A defined dome-shaped recirculation zone 16, at the tip of which ignition occurs, is formed at the burner outlet. The flame itself is stabilized in front of the burner 11 by the recirculation zone 16 without the need for a mechanical flame holder.

In FIG. 4, nozzles 10 are arranged radially in a nozzle head 30. The number of nozzles 10 per nozzle head 30 must be matched to the respective requirements. By virtue of the radial arrangement of the nozzles 10, the fuel is introduced normal to the combustion air 19, thereby increasing the depth to which the fuel droplets penetrate into the combustion air. In this arrangement of the nozzles 10, the feed passage 2 is perpendicular to the direction of introduction of the fuel. The fuel is therefore guided around the nozzles 10 in a ring.

The depth to which the fuel droplets penetrate into the combustion air is further increased if the air 5 is passed through the nozzles 10 at supersonic speed.

Figure 5:
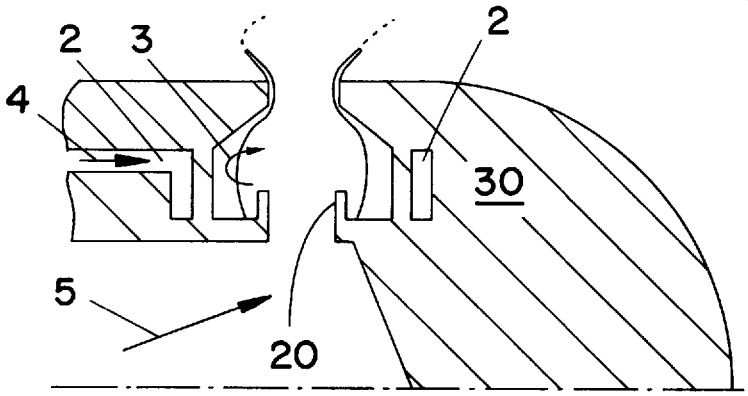
FIG. 5 shows a partial longitudinal section through a nozzle with turbulence chambers.
Figure 5:
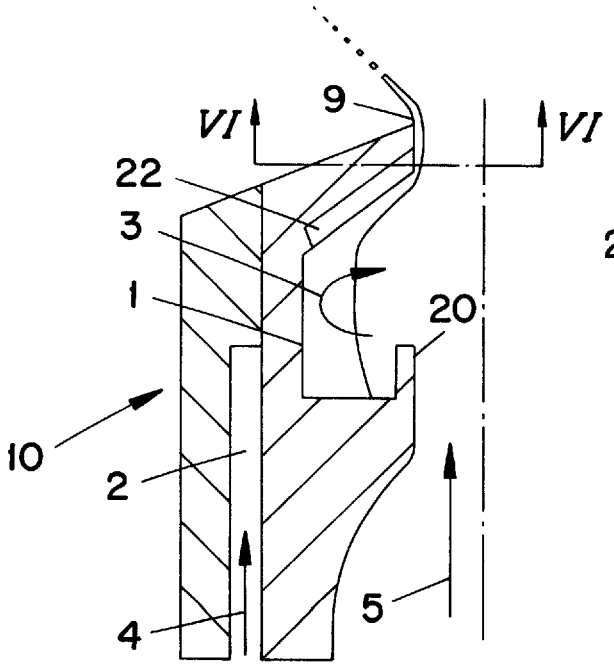
Figure 6:
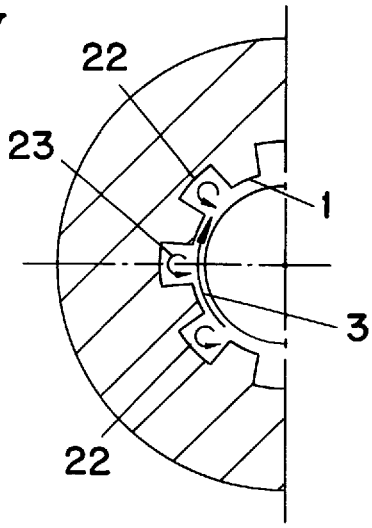
FIG. 6 shows a partial cross-section through the nozzle along the line VI—VI in FIG. 5.

In FIGS. 5 and 6, small recesses 22 which extend in the direction of flow are machined into the region of the cone 8 of the swirl chamber 1 of the nozzle 10, and these recesses act as turbulence chambers.

In these turbulence chambers 22, the swirling flow 3 gives rise to longitudinal vortices 23. These vortices 23 increase the turbulence of the fuel film at the atomization edge 9 and reduce the size of the fuel droplets formed by the nozzle.

In FIG. 7, the dividing wall 20 is designed as a tubular insert 21, considerably simplifying the manufacture of the nozzle 10. If the air 5 is to be passed through the center of the swirl chamber 5 at supersonic speed, it is advantageous to shape the dividing wall 20 or the tubular insert 21 as a Laval nozzle. If the air 5 is at a sufficient pressure, the Laval nozzle serves to produce the supersonic flow. The Laval nozzle furthermore gives rise to additional high-frequency oscillations of the shock waves, thereby producing very fine fuel droplets.

Obviously, numerous modifications and variations of the present invention are possible in light of the above teachings. The configuration of the nozzle with an internal Laval nozzle when supersonic flow is employed is, of course, independent of the use of a tubular insert. It is also possible to employ the integral design of the nozzle shown in FIG. 1. It is therefore to be understood that within the scope of the appended claims, the invention may be practiced otherwise than as specifically described herein.

What is claimed as new and desired to be secured by Letters Patent of the United States is:

1. A method for operating a fuel injector for atomization of the fuel, the fuel injector having a cylindrical hollow body having an outlet port, the outlet opening forming an atomization edge, the body defining an interior swirl chamber having an axial flow direction leading to the outlet port, the swirl chamber having a cone-shaped portion narrowing toward the outlet port, the body further defining an air duct with a mouth connecting to an upstream end of the swirl chamber, the body defining at least one fuel feed passage to guide fuel into the body and at least one inlet opening leading laterally from the at least one fuel feed passage to the swirl chamber downstream of the mouth, and the body having a dividing wall extending axially downstream from the mouth at least to a center of the at least one inlet opening, the method comprising the steps of:

feeding fuel through the inlet opening into the swirl chamber, wherein a swirling film flow of fuel is produced on a surface of the swirl chamber; and introducing atomization air from the air duct into the swirl chamber;

wherein, the fuel film upon reaching the atomization edge is broken into droplets, and wherein the atomization air applies additional shear forces to the fuel film and assists the break-up of the fuel into droplets.

2. The method for fuel injection as claimed in claim 1, wherein the atomization air is introduced into the swirl chamber at supersonic speed and wherein shock waves produced by the supersonic flow assist the atomization of the fuel.

3. The method for fuel injection as claimed in claim 1, wherein the dividing wall is shaped as a Laval nozzle, and wherein the atomization air entering the swirl chamber is accelerated to supersonic speed by the Laval nozzle.

4. The method for fuel injection as claimed in claim 1, wherein a plurality of fuel injectors are arranged radially in a nozzle head disposed in a combustion air flow and extending in the air flow direction, and wherein the method comprises injecting the fuel into the combustion air essentially perpendicular to the combustion air flow direction.

5. A fuel injection nozzle for atomizing liquid fuel, comprising a cylindrical hollow body having an outlet port, the body defining an interior swirl chamber having an axial flow direction leading to the outlet port, the swirl chamber having a cone-shaped portion narrowing toward the outlet port, the body further defining an air duct with a mouth connecting to an upstream end of the swirl chamber, the body defining at least one fuel feed passage to guide fuel into the body and at least one inlet opening leading laterally from the at least one fuel feed passage to the swirl chamber downstream of the mouth, and the body having a dividing wall extending axially downstream from the mouth at least to a center of the at least one inlet opening to separate fuel entering the swirl chamber from atomization air entering the swirl chamber to allow a fuel film to form on the swirl chamber.

6. The device as claimed in claim 5, wherein the body includes recesses which extend in the flow direction formed in an interior surface of the body in the cone-shaped portion of the swirl chamber, said recesses serving as turbulence chambers for generating turbulence in the fuel flow.

7. The device as claimed in claim 5, wherein the dividing wall in the interior of the hollow body is designed as a Laval nozzle to accelerate the atomizing air entering the swirl chamber to supersonic speed.

8. The device as claimed in claim 5, wherein a plurality of fuel injection nozzles are arranged radially in a longitudinally extending nozzle head.

* * * * *